US008037854B2

(12) United States Patent
Lee

(10) Patent No.: US 8,037,854 B2
(45) Date of Patent: Oct. 18, 2011

(54) HYDRAULIC PRESSURE CONTROL DEVICE OF VARIABLE VALVE SYSTEM

(75) Inventor: Youngsoo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 508 days.

(21) Appl. No.: 12/325,879

(22) Filed: Dec. 1, 2008

(65) Prior Publication Data

US 2009/0151679 A1 Jun. 18, 2009

(30) Foreign Application Priority Data

Dec. 14, 2007 (KR) ..... 10-2007-0131675

(51) Int. Cl.
*F01L 9/02* (2006.01)

(52) U.S. Cl. ..... 123/90.12; 123/90.13; 123/90.16

(58) Field of Classification Search ..... 123/90.12, 123/90.13, 90.16
See application file for complete search history.

(56) References Cited

U.S. PATENT DOCUMENTS 7,178,489 B2 * 2/2007 Tanaka ..... 123/90.12

* cited by examiner

*Primary Examiner* — Ching Chang
(74) *Attorney, Agent, or Firm* — Morgan, Lewis & Bockius LLP

(57) ABSTRACT

A hydraulic pressure control apparatus of a variable valve system may include a variable valve device for controlling lift characteristics of a valve, a hydraulic pressure control pipe in which an slot is formed from the interior toward the exterior and hydraulic pressure is supplied to the inside thereof, and a driving unit for rotating the hydraulic pressure control pipe, wherein the hydraulic pressure is selectively transferred to the variable valve through the slot according to a rotation of the hydraulic pressure control pipe.

18 Claims, 6 Drawing Sheets

HYDRAULIC PRESSURE CONTROL DEVICE OF VARIABLE VALVE SYSTEM

CROSS-REFERENCE TO RELATED APPLICATION

The present application claims priority to Korean Patent Application Number 10-2007-0131675 filed Dec. 14, 2007, the entire contents of which application is incorporated herein for all purposes by this reference.

BACKGROUND OF THE INVENTION

1. Field of the Invention

The present invention relates to a valve system, and more particularly to a hydraulic pressure control apparatus of a variable valve system.

2. Description of Related Art

Generally, technical investigations have been undertaken in a variety of fields of the vehicle industry. Among them, the technical field for improving fuel efficiency of an engine is very important in energy saving and environmental aspects.

An engine that has a cylinder deactivation function (CDA) deactivates a combustion chamber in an idle state or low load driving condition such that fuel efficiency is improved.

FIG. 1 is a partial perspective view of a general variable valve system, and FIG. 2 is a schematic diagram showing a hydraulic pressure control circuit of a general variable valve system.

As shown, the valve system is equipped with a variable tappet (a switchable tappet). The variable tappet is mounted on an upper end portion of a valve stem 1*a*.

The variable tappet includes an inner tappet 3, an outer tappet 5 supported by a spring 1*b*, and a locking pin 7. And, a first cam 13 and a second cam 11 are formed on a camshaft 9.

The first cam 13 corresponds to the outer tappet 5, and the second cam 11 corresponds to the inner tappet 3. When the inner tappet 3 and the outer tappet 5 are engaged, the valve performs a high lift, and when the inner tappet 3 and the outer tappet 5 are not engaged, the valve performs a low lift, according to a position of the locking pin 7 that is moved by hydraulic pressure.

Referring to FIG. 2, variable tappets 105*a* and 105*b* are respectively disposed at an intake side and an exhaust side of a first cylinder (cyl. 1), and variable tappets 110*a* and 110*b* are respectively disposed at an intake side and an exhaust side of a fourth cylinder (cyl. 4).

Hydraulic pressure lines 120*a* and 120*b* are respectively disposed corresponding to the intake side and the exhaust side, and oil control valves (OCV) 100*a* and 100*b* are disposed in the respective hydraulic pressure lines 120*a* and 120*b*. The oil control valves 100*a* and 100*b* simultaneously supply the hydraulic pressure to the two cylinders (cyl. 1 and 4) such that the hydraulic pressure cannot be transferred with optimum timing.

Also, the oil control valves 100*a* and 100*b* are operated by an electrical system such that there is a high probability in that the oil control valves may malfunction. In addition, the oil control valves 100*a* and 100*b* increase manufacturing cost.

The information disclosed in this Background of the Invention section is only for enhancement of understanding of the general background of the invention and should not be taken as an acknowledgement or any form of suggestion that this information forms the prior art already known to a person skilled in the art.

SUMMARY OF THE INVENTION

Various aspects of the present invention are directed to provide for a hydraulic pressure control apparatus of a variable valve system having advantages of supplying respective cylinders with a hydraulic pressure with optimum timing and reducing a cost.

In an aspect of the present invention, a hydraulic pressure control apparatus of a variable valve system may include a variable valve device for controlling lift characteristics of a valve, a hydraulic pressure control pipe including a slot configured to pass from the interior toward the exterior thereof to supply hydraulic pressure to the variable valve device, and/or a driving unit for rotating the hydraulic pressure control pipe, wherein the hydraulic pressure supplied to the inside of the hydraulic pressure control pipe is selectively transferred to the variable valve device through the slot according to a rotation of the hydraulic pressure control pipe.

Length of the slot may be formed approximately within 90° in a rotation direction of the hydraulic pressure control pipe with respect to a rotation axis thereof.

The driving unit may include a motor connected to an electronic control unit, wherein the motor and one end portion of the hydraulic pressure control pipe is detachably coupled each other. A cap may be disposed in the one end portion of the hydraulic pressure control pipe, and the hydraulic pressure may be supplied through the other end portion thereof. A female slot may be formed in end surface of the cap or end portion of the motor, and a male projection may be formed in the end portion of the motor or the end surface of the cap, corresponding to the female slot.

The hydraulic pressure control pipe may be inserted into a pipe hole formed in a cylinder head and mounted therethrough, and a fluid passage may be formed between the pipe hole and the variable valve device through the slot. The cylinder head may include a groove formed in an interior surface of the pipe hole, and the fluid passage is selectively formed between the groove and the slot by the rotation of the hydraulic pressure control pipe.

The lift characteristics of the valve may include lift amount, lift timing, and lift maintaining time.

The variable valve device further includes a variable tappet that is disposed between a cam and the valve.

The hydraulic pressure control pipe may further include a first hydraulic pressure control pipe having a first slot and disposed at intake side of the cylinder engine to fluidly communicate with intake ports of the variable valve device, and/or a second hydraulic pressure control pipe having a second slot and disposed at exhaust side of the cylinder engine to fluidly communicate with exhaust ports of the variable valve device. The first and second slots of the first and second hydraulic pressure control pipes may have a phase shift of 180° therebetween. The first hydraulic pressure control pipe may be inserted into a first pipe hole formed at the intake side of the cylinder head so that a first fluid passage is formed between the first hydraulic pressure control pipe and the intake ports though the first slot, and the second hydraulic pressure control pipe may be inserted into a second pipe hole formed at the exhaust side of the cylinder head so that a second fluid passage is formed between the second hydraulic pressure control pipe and the exhaust parts through the second slot. The cylinder head may include a first groove formed in an interior surface of the first pipe hole, and the first fluid passage is selectively formed between the first groove and the first slot by rotation of the first hydraulic pressure control pipe and wherein the cylinder head includes a second groove formed in an interior surface of the second pipe hole, and the second fluid passage is selectively formed between the second groove and the second slot by rotation of the second hydraulic pressure control pipe.

The first and second pressure control pipes may be connected to the intake side and the exhaust side of the cylinder block including first, second, third and fourth cylinders. Phase shift of the first and second slots formed at the respective first and second pressure control pipes between the first and third cylinders may be 90°, phase shift of the first and second slots formed at the respective first and second pressure control pipes between the third and fourth cylinders may be 90°, phase shift of the first and second slots formed at the respective first and second pressure control pipes between the fourth and second cylinders may be 90°, and phase shift of the first and second slots formed at the respective first and second pressure control pipes between the first and fourth cylinder may be 180° so that when the fourth cylinder is de-activated after de-activation of the first cylinder, the hydraulic pressure control pipe rotates 180°.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE EMBODIMENTS

Figure 1:
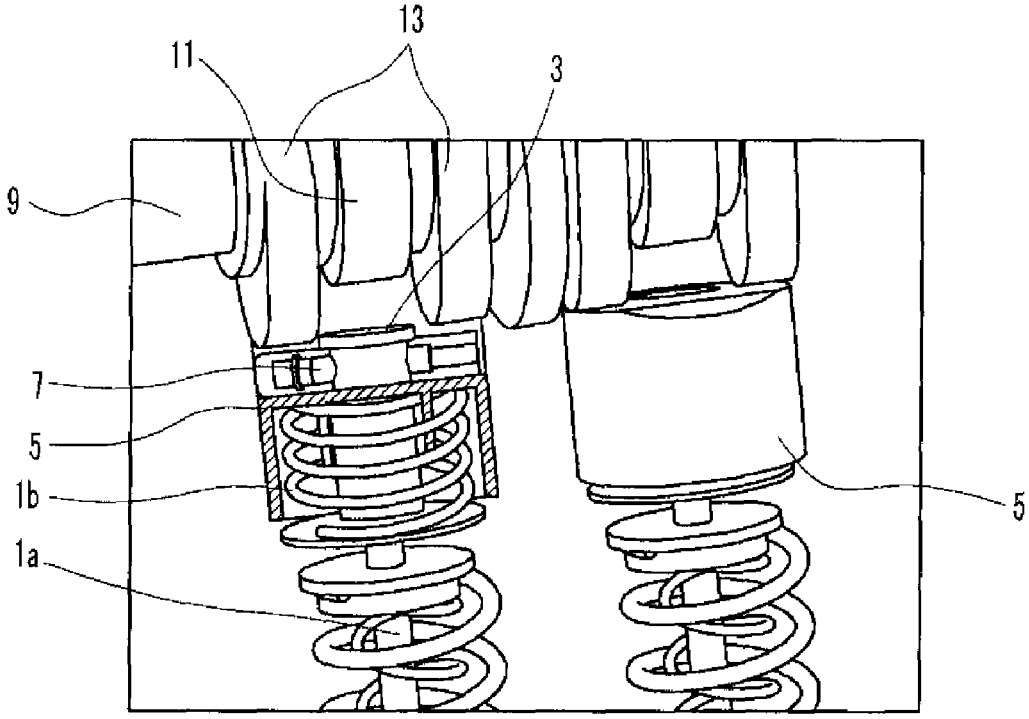
FIG.1 (Prior Art)
FIG. 1 is a partial perspective view of a general variable valve system.
Figure 1:
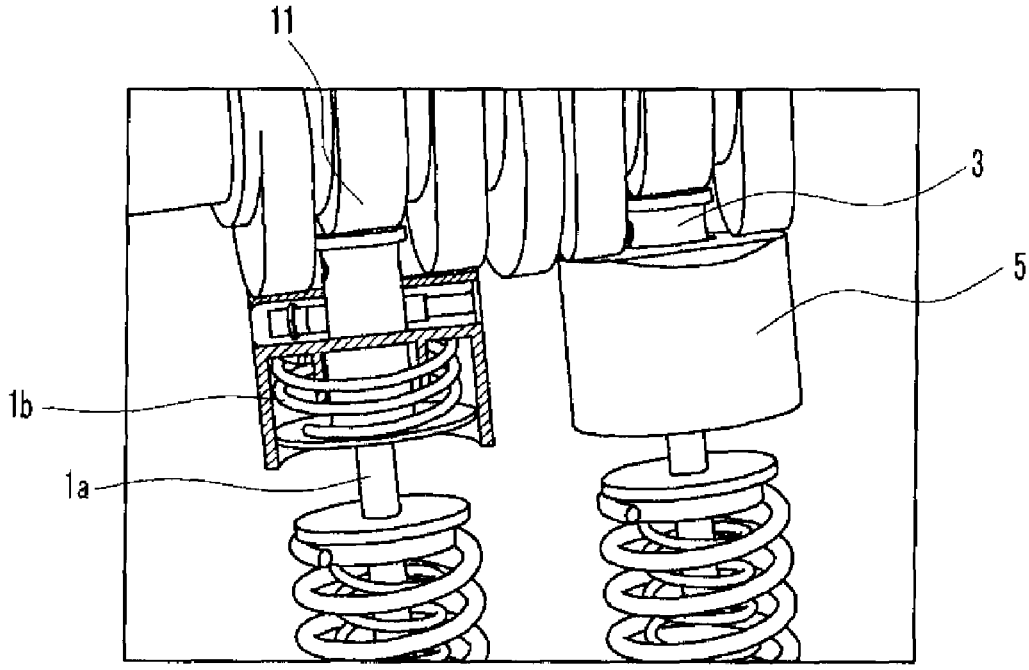
FIG.1 (Prior Art)
Figure 2:
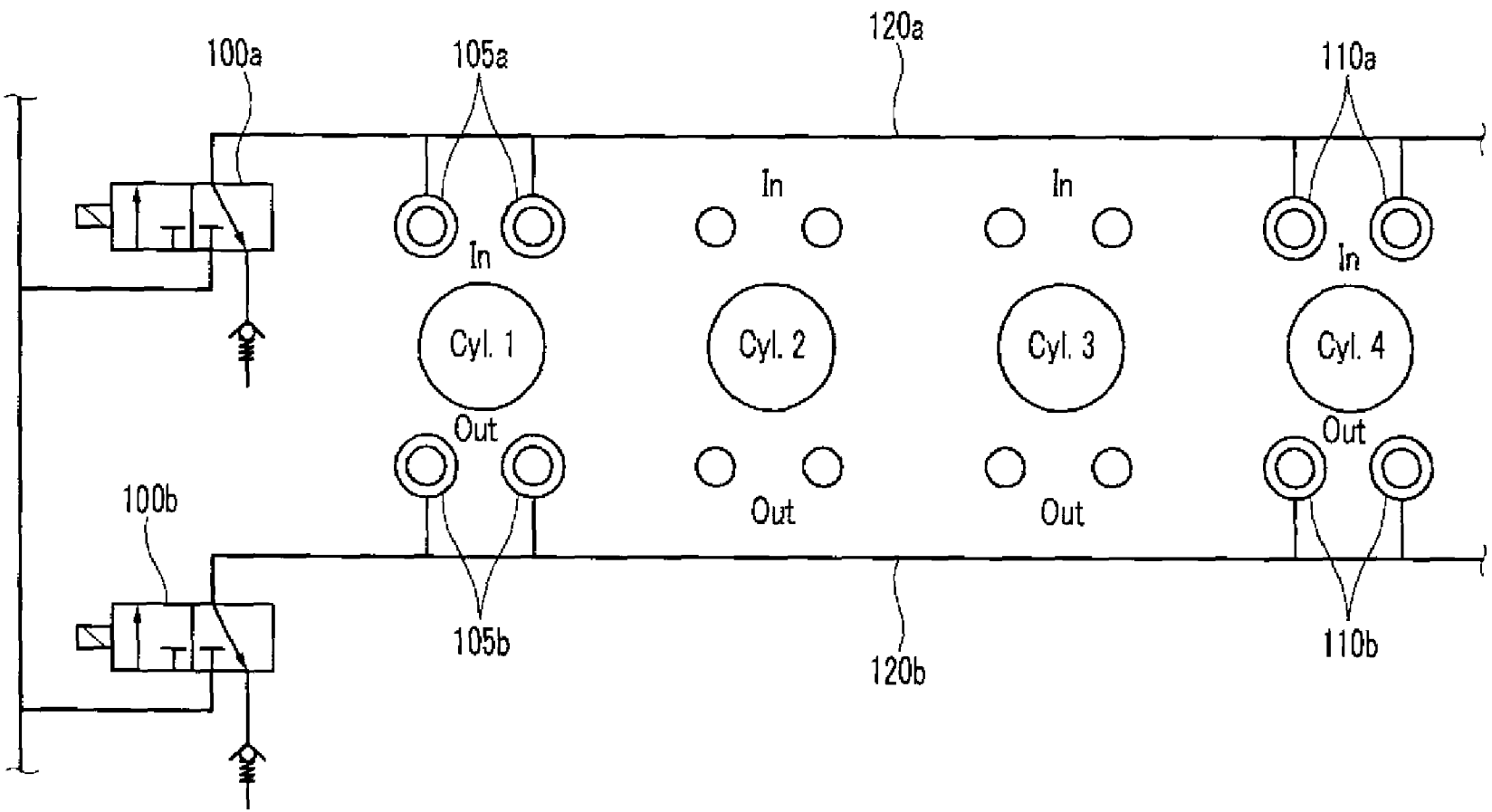
FIG.2 (Prior Art)
FIG. 2 is a schematic diagram showing a hydraulic pressure control circuit of a general variable valve system.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The drawings and description are to be regarded as illustrative in nature and not restrictive. Like reference numerals designate like elements throughout the specification.

Figure 3:
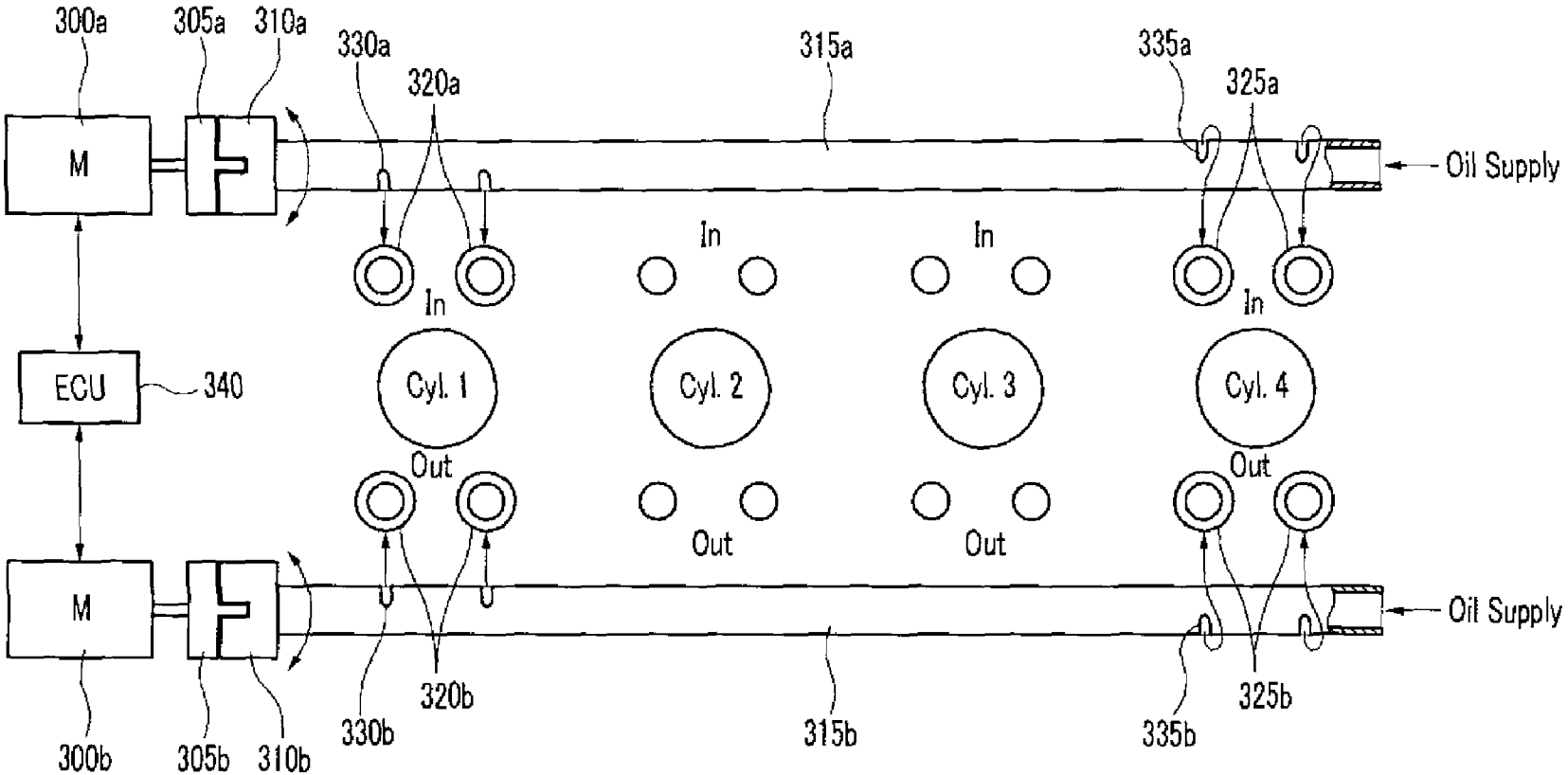
FIG. 3 is a schematic diagram of an exemplary variable valve system according to the present invention.

FIG. 3 is a schematic diagram of a variable valve system according to various exemplary embodiments of the present invention.

Referring to FIG. 3, a variable valve system includes motors 300*a* and 300*b*, first rotation members 305*a* and 305*b*, second rotation members 310*a* and 310*b*, hydraulic pressure control pipes 315*a* and 315*b*, and variable valve devices 320*a*, 320*b*, 325*a*, and 325*b*.

The hydraulic pressure control pipes 315*a* and 315*b* are respectively disposed at an intake side and an exhaust side. The variable valve devices 320*a* and 320*b* are disposed at the exhaust side and the intake side of the first cylinder (cyl. 1). Further, the variable valve devices 325*a* and 325*b* are disposed at the exhaust side and the intake side of the fourth cylinder (cyl. 4).

Slots 330*a* (330*b*) and 335*a* (335*b*) are formed in the hydraulic pressure control pipe 315*a* (315*b*) corresponding to the variable valve device 325*a* (325*b*). The motor 300*a* is connected to one end portion of the hydraulic pressure control pipe 315*a*, and the hydraulic pressure is supplied to the other end portion thereof.

The motor 300*a* is electrically connected with an electronic control unit 340, and is controlled by the electronic control unit 340. The hydraulic pressure in the hydraulic pressure control pipe 315*a* is transferred to the variable valve devices 320*a* and 325*a* through the slots 330*a* and 335*a* according to a rotation of the hydraulic pressure control pipe 315*a*.

Figure 4:
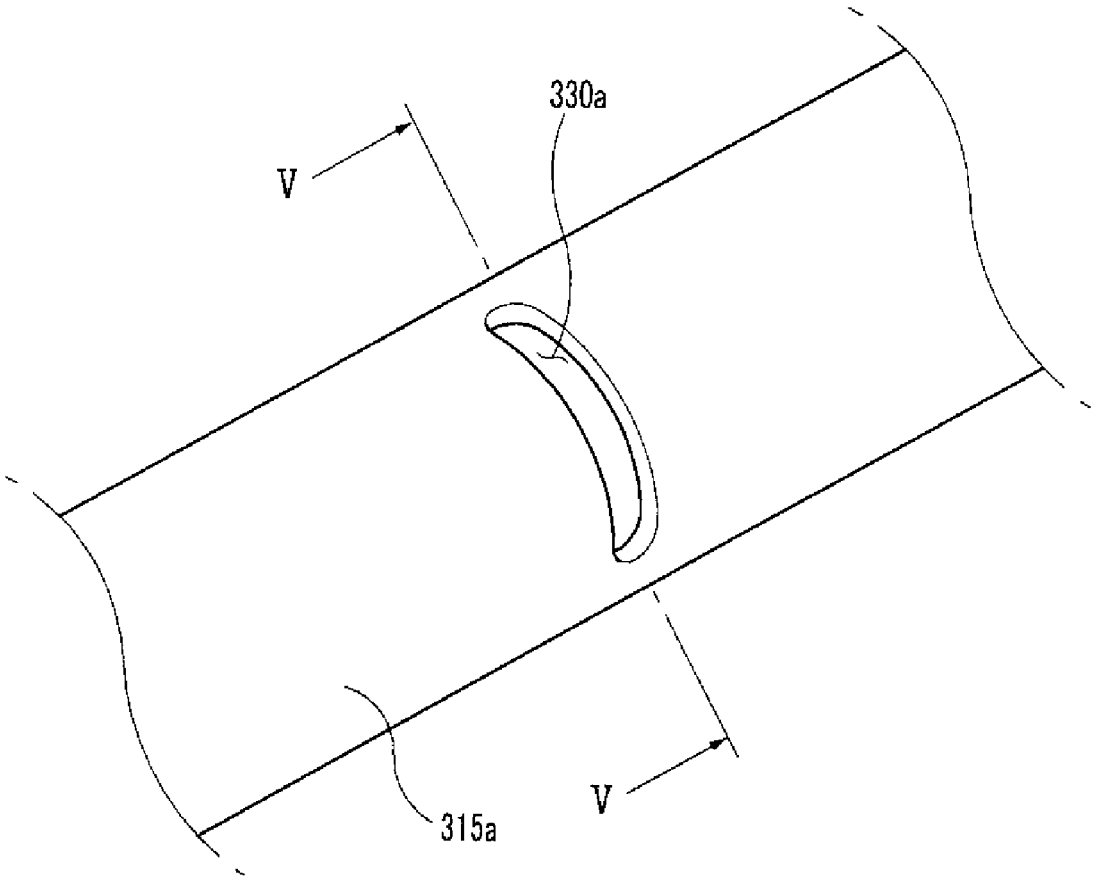
FIG. 4 is a partial perspective view of an exemplary variable valve system according to the present invention.

FIG. 4 is a partial perspective view of a variable valve system according to various embodiments of the present invention.

Referring to FIG. 4, the slot 330*a* is formed to be opened from the interior toward the exterior in the hydraulic pressure control pipe 315*a*, and is extended in a rotation direction of the hydraulic pressure control pipe 315*a*.

More specifically, the slot 330*a* is formed within 90° in a rotating direction. However, the shape and the angle range of the slot 330*a* can be modified according to various engine specifications and design performance.

Figure 5:
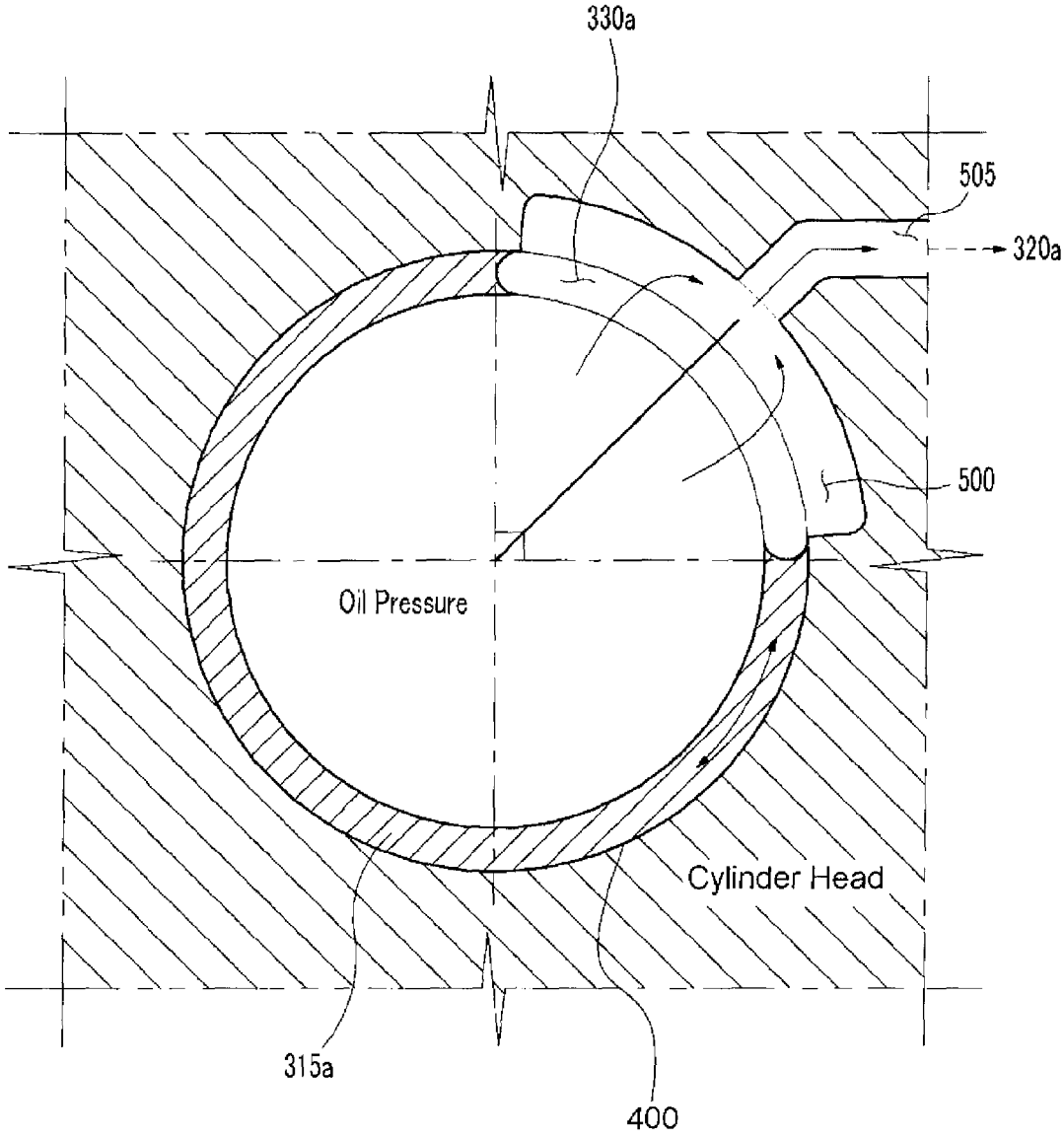
FIG. 5 is a partial cross-sectional view of an exemplary variable valve system according to the present invention.

FIG. 5 is a partial cross-sectional view of a variable valve system according to various embodiments of the present invention.

Referring to FIG. 5, a pipe hole 400 is formed in the cylinder head, and the hydraulic pressure control pipe 315*a* is inserted through the pipe hole 400. It is desirable that there is no gap between the interior surface of the pipe hole 400 and the exterior surface of the hydraulic pressure control pipe 315*a*.

A groove 500 is formed in the interior surface of the pipe hole 400, and a fluid passage 505 is formed to the groove 500. The hydraulic pressure is transferred through the slot 330*a* that is formed in the hydraulic pressure control pipe 315*a*. Also, the hydraulic pressure is transferred to the variable valve device (320*a*, FIG. 3) through the groove 500 and the fluid passage 505.

Referring to FIG. 5, when the hydraulic pressure control pipe 315*a* rotates 90° in a clockwise direction, the hydraulic pressure is not transferred to the groove 500.

Figure 6:
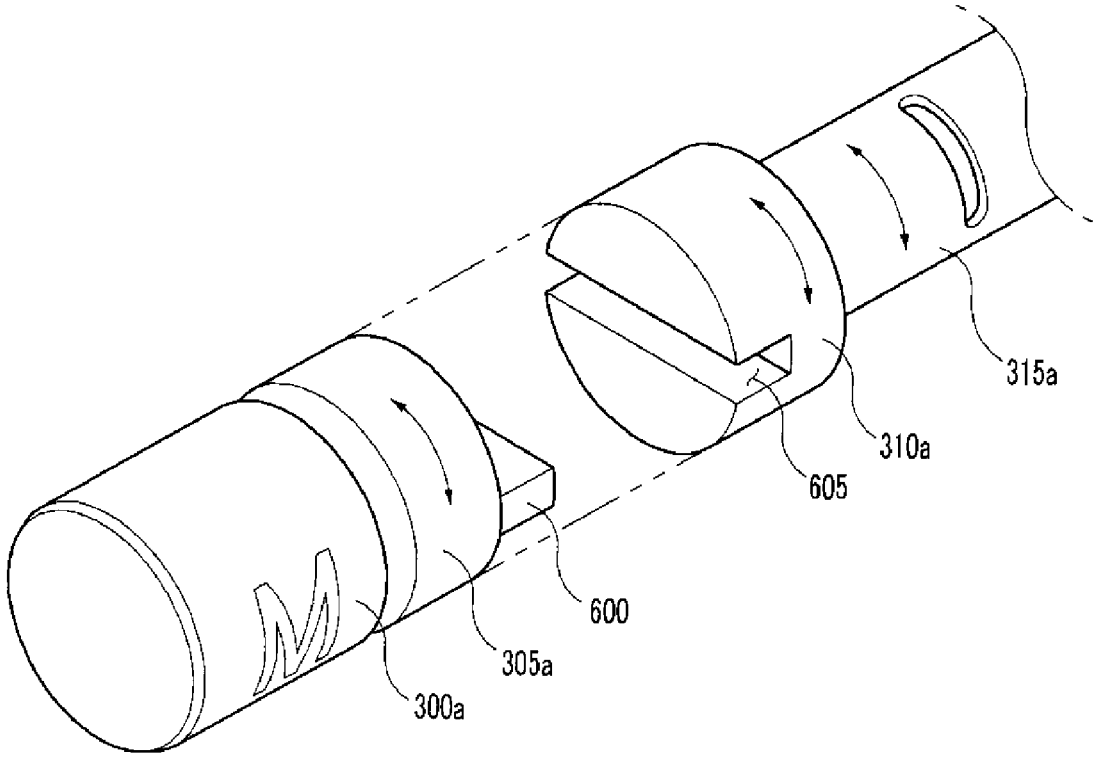
FIG. 6 is a partial exploded perspective view of an exemplary variable valve system according to the present invention.

FIG. 6 is a partial exploded perspective view of a variable valve system according to various embodiments of the present invention.

Referring to FIG. 6, the first rotation member 305*a* is mounted on an end portion of the motor 300*a*, and the second rotation member 310*a* is mounted on an end portion of the hydraulic pressure control pipe 315*a*. The first rotation member 305*a* and the second rotation member 310*a* are engaged with each other, and the torque of the motor 300*a* is transferred to the hydraulic pressure control pipe 315*a*.

The second rotation member 310*a* operates as a plug or a cap that is installed on the end portion of the hydraulic pressure control pipe 315*a*.

A female slot 605 is formed in an end surface of the second rotation member 310*a* facing the first rotation member 305*a*. A male projection 600 that is inserted into the female slot 605 protrudes from the first rotation member 305*a*.

Due to the structure that is stated above, assembly or disassembly of the first rotation member 305*a* and the second rotation member 310*a* become easier such that maintenance thereof also becomes easier.

The motor 300*a* that is controlled by the electronic control unit (340, FIG. 3) rotates the hydraulic pressure control pipe 315*a* with optimal timing. Accordingly, with accurate timing, the hydraulic pressure is supplied to the variable valve devices 320*a* and 325*a* that are disposed in the respective cylinders (cyls. 1 and 4).

The hydraulic pressure control pipe 315*a* is inserted into the pipe hole 400 that is formed in the cylinder head to be installed therein, and the motor 300*a* can be installed on a timing chain cover.

The variable valve devices (320*a* and 320*b*, FIG. 3) can include a variable tappet device in various embodiments of the present invention. Further, the variable valve devices 320*a* and 320*b* can include a variable valve lift device (VVL) that adjusts a movement characteristic of a rocker arm so as to control a valve lift amount.

In addition, the variable valve devices 320*a* and 320*b* can include a variable valve lift device (VVL) that adjusts a movement characteristic of a swing arm so as to control a valve lift amount.

In various embodiments of the present invention, the variable valve devices 320*a* and 320*b* can includes a variable valve timing device (VVT) for controlling valve lift timing.

As described above, the hydraulic pressure that is transferred to the variable valve device 320*a* and 320*b* is mechanically controlled such that a malfunction is prevented and precision can be improved. Also, an expensive control valve is not be used such that production cost can be reduced.

Referring to FIG. 3, the firing order of a four cylinder engine is the first cylinder (cyl. 1), the third cylinder (cyl. 3), the fourth cylinder (cyl. 4), and the second cylinder (cyl. 2), and the fourth cylinder (cyl. 4) is deactivated after deactivation of the first cylinder (cyl. 1). That is, the periods in which the first cylinder (cyl. 1) and the fourth cylinder (cyl. 4) are deactivated have a time difference from each other.

The hydraulic pressure control pipes 315*a* and 315*b* are to be rotated with appropriate timing so as to deactivate the first cylinder (cyl. 1) and the fourth cylinder (cyl. 4) with appropriate timing.

The hydraulic pressure control pipes 315*a* and 315*b* can be rotated 180° so as to deactivate the fourth cylinder (cyl. 4) after the deactivation of the first cylinder (cyl. 1) in various embodiments of the present invention.

The hydraulic pressure control pipe 315*a* can rotate continuously in various embodiments of the present invention. Also, the rotation speed of the hydraulic pressure control pipe 315*a* can be increased corresponding to that of the engine. On a contrary, the hydraulic pressure control pipe 315*a* can alternately repeat rotation and stopping.

For convenience in explanation and accurate definition in the appended claims, the terms "upper", "inside", "interior", and "exterior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A hydraulic pressure control apparatus of a variable valve system, comprising:

a variable valve device for controlling lift characteristics of a valve;

a hydraulic pressure control pipe including a slot configured to pass from the interior toward the exterior thereof to supply hydraulic pressure to the variable valve device; and a driving unit for rotating the hydraulic pressure control pipe, wherein the hydraulic pressure supplied to the inside of the hydraulic pressure control pipe is selectively transferred to the variable valve device through the slot according to a rotation of the hydraulic pressure control pipe.

2. The hydraulic pressure control apparatus of claim 1, wherein length of the slot is formed approximately within 90° in a rotation direction of the hydraulic pressure control pipe with respect to a rotation axis thereof.

3. The hydraulic pressure control apparatus of claim 1, wherein the driving unit includes a motor connected to an electronic control unit.

4. The hydraulic pressure control apparatus of claim 3, wherein the motor and one end portion of the hydraulic pressure control pipe is detachably coupled each other.

5. The hydraulic pressure control apparatus of claim 4, wherein a cap is disposed in the one end portion of the hydraulic pressure control pipe, and the hydraulic pressure is supplied through the other end portion thereof.

6. The hydraulic pressure control apparatus of claim 5, wherein a female slot is formed in end surface of the cap or end portion of the motor, and a male projection is formed in the end portion of the motor or the end surface of the cap, corresponding to the female slot.

7. The hydraulic pressure control apparatus of claim 1, wherein the hydraulic pressure control pipe is inserted into a pipe hole formed in a cylinder head and mounted therethrough, and a fluid passage is formed between the pipe hole and the variable valve device through the slot.

8. The hydraulic pressure control apparatus of claim 7, wherein the cylinder head comprises a groove formed in an interior surface of the pipe hole, and the fluid passage is selectively formed between the groove and the slot by the rotation of the hydraulic pressure control pipe.

9. The hydraulic pressure control apparatus of claim 1, wherein the lift characteristics of the valve include lift amount, lift timing, and lift maintaining time.

10. The hydraulic pressure control apparatus of claim 1, comprising the variable valve device that further includes a variable tappet that is disposed between a cam and the valve.

11. The hydraulic pressure control apparatus of claim 1, wherein the hydraulic pressure control pipe further includes:

a first hydraulic pressure control pipe having a first slot and disposed at intake side of the cylinder engine to fluidly communicate with intake ports of the variable valve device; and a second hydraulic pressure control pipe having a second slot and disposed at exhaust side of the cylinder engine to fluidly communicate with exhaust ports of the variable valve device.

12. The hydraulic pressure control apparatus of claim 11, wherein the first and second slots of the first and second hydraulic pressure control pipes have a phase shift of 180° therebetween.

13. The hydraulic pressure control apparatus of claim 12, wherein the first hydraulic pressure control pipe is inserted into a first pipe hole formed at the intake side of the cylinder head so that a first fluid passage is formed between the first hydraulic pressure control pipe and the intake ports though the first slot, and the second hydraulic pressure control pipe is inserted into a second pipe hole formed at the exhaust side of the cylinder head so that a second fluid passage is formed between the second hydraulic pressure control pipe and the exhaust parts through the second slot.

14. The hydraulic pressure control apparatus of claim 13, wherein the cylinder head comprises a first groove formed in an interior surface of the first pipe hole, and the first fluid passage is selectively formed between the first groove and the first slot by rotation of the first hydraulic pressure control pipe and wherein the cylinder head comprises a second groove formed in an interior surface of the second pipe hole, and the second fluid passage is selectively formed between the second groove and the second slot by rotation of the second hydraulic pressure control pipe.

15. The hydraulic pressure control apparatus of claim 14, wherein the first and second pressure control pipes are connected to the intake side and the exhaust side of the cylinder block comprising first, second, third and fourth cylinders.

16. The hydraulic pressure control apparatus of claim 15, wherein phase shift of the first and second slots formed at the respective first and second pressure control pipes between the first and third cylinders are 90°, phase shift of the first and second slots formed at the respective first and second pressure control pipes between the third and fourth cylinders are 90°, phase shift of the first and second slots formed at the respective first and second pressure control pipes between the fourth and second cylinders are 90°, and phase shift of the first and second slots formed at the respective first and second pressure control pipes between the first and fourth cylinder are 180° so that when the fourth cylinder is de-activated after de-activation of the first cylinder, the hydraulic pressure control pipe rotates 180°.

17. An engine comprising the hydraulic pressure control apparatus of claim 1.

18. A passenger vehicle comprising an engine comprising the hydraulic pressure control apparatus of claim 1.

* * * * *